US007823319B2

(12) United States Patent
Casas Salva

(10) Patent No.: US 7,823,319 B2
(45) Date of Patent: Nov. 2, 2010

(54) PROTECTIVE COVER FOR SPORTING RIFLES

(75) Inventor: Francisco Casas Salva, Sam Boi De Llobregat (ES)

(73) Assignee: Gamo Outdoor, S.L., Barcelona (ES)

( * ) Notice: Subject to any disclaimer, the term of this patent is extended or adjusted under 35 U.S.C. 154(b) by 0 days.

(21) Appl. No.: 10/580,218

(22) PCT Filed: Oct. 6, 2004

(86) PCT No.: PCT/ES2004/000434

§ 371 (c)(1),
(2), (4) Date: May 22, 2006

(87) PCT Pub. No.: WO2005/050124

PCT Pub. Date: Jun. 2, 2005

(65) Prior Publication Data

US 2007/0006511 A1 Jan. 11, 2007

(30) Foreign Application Priority Data

Nov. 24, 2003 (ES) ..... 200302708 U

(51) Int. Cl.
*F41A 35/04* (2006.01)

(52) U.S. Cl. ..... 42/96; 42/71.01; 42/74; 42/75.02

(58) Field of Classification Search ..... 42/96, 42/71.01, 74, 75.02, 75.01, 71.02, 72
See application file for complete search history.

(56) References Cited

U.S. PATENT DOCUMENTS 1,795,840 A * 3/1931 Crisler ..... 42/74
2,104,129 A * 1/1938 Kress ..... 42/71.01
2,308,627 A * 1/1943 Rickenbacher ..... 42/71.02
2,832,165 A * 4/1958 Ivy ..... 42/16
3,023,527 A * 3/1962 Leek et al. ..... 42/71.01
3,672,084 A * 6/1972 Pachmayr ..... 42/71.02
3,961,436 A * 6/1976 Hagen et al. ..... 42/75.02
4,315,379 A * 2/1982 Lang ..... 42/71.02
4,328,634 A * 5/1982 Wiltrout ..... 42/96
4,531,639 A * 7/1985 Zopf ..... 206/523
4,674,216 A * 6/1987 Ruger et al. ..... 42/71.01
5,048,215 A * 9/1991 Davis ..... 42/72
5,294,013 A * 3/1994 Sasaki ..... 220/241
5,465,520 A * 11/1995 Cupp ..... 42/71.02
5,720,193 A * 2/1998 Dick ..... 70/298
5,778,590 A * 7/1998 Browning et al. ..... 42/96
6,070,354 A * 6/2000 Burigana et al. ..... 42/71.01
6,164,004 A * 12/2000 Essary ..... 42/96
6,301,817 B1 * 10/2001 Hogue et al. ..... 42/71.01
6,536,152 B1 * 3/2003 Wisz ..... 42/71.01
7,191,557 B2 * 3/2007 Gablowski et al. ..... 42/72
2004/0064994 A1 * 4/2004 Luke ..... 42/85

* cited by examiner

*Primary Examiner*—Michelle Clement
(74) *Attorney, Agent, or Firm*—Townsend and Townsend and Crew LLP

(57) ABSTRACT

The invention relates to a protective cover which is intended for sporting rifles that comprise screws (2) which are used to fix a shell propulsion mechanism (3) to a rifle support (4). The invention is characterised in that the dimensions of the cover (5) are pre-determined as a function of the area to be covered, said area to be covered including the heads (1) of the screws (2) which are used to fix the shell propulsion mechanism (3) to the support (4). The invention is further characterised in that it comprises means for fixing the cover to the sporting rifle.

10 Claims, 1 Drawing Sheet

PROTECTIVE COVER FOR SPORTING RIFLES

This application is a U.S. national phase of International Application No. PCT/ES2004/000434 filed Oct. 6, 2004, which designated the U.S. and claims priority to Spanish Application No. 200302708 filed Nov. 24, 2003, the entire contents of each of which are hereby incorporated by reference.

Protective cover which is intended for sporting rifles that comprise of screws which are used to fix a shell propulsion mechanism to a rifle support, in which the referred cover has predetermined dimensions in function of the area to be covered, said area to be covered including the heads of the screws that fix the shell propulsion mechanism and because it also comprises means for fixing the cover to the mentioned sporting rifle.

BACKGROUND OF THE INVENTION

The most usual method of securing the shell propulsion mechanism of sporting rifles to their supports is that based on inserting screws, normally in an oblique fashion, passING through the said support to be finally screwed into the exterior wall of the said shell propulsion mechanism, with their heads visible from the external face of the support which, together with its oblique layout makes these project somewhat and produce a quite anti-aesthetic effect, in addition to being potentially dangerous to the rifle user, with injury to his hands when they rub against the heads of the said screws.

Spanish Patent application No. 200002464, which issued as Spanish Patent No. 2,194,564, from the same applicant, proposes an articulation device for a shell propulsion mechanism in a compressed air rifle or pistol with a tilting shell propulsion mechanism. The said application describes a system to secure the device to the but body similar to that of the previous paragraph, by means of a series of pass-through holes, preferably located in a radial orientation, in symmetrical angular positions with respect to a longitudinal vertical plane of the rifle or pistol, through which securing screws are inserted that are screwed into nuts. This same patent application does not describe any system to hide these screws from sight.

BRIEF DESCRIPTION OF THE INVENTION

This invention proposes a protective cover applicable to sporting rifles, to cover the heads of the screws that secure the shell propulsion mechanism to the support of the said rifle, thus hiding and protecting the said heads, with the subsequent functional and aesthetic benefit.

The inventor has observed that the fact of covering the said screws involves several advantages for the rifle. On the one hand, the screws are out of reach of eroding agents, such as dust, water and mud which, at time can make it difficult to unscrew and separate the shell propulsion mechanism from the rifle support when it is to be cleaned.

On the other hand, the exterior attractiveness of the rifle is increased, since much more continuous lines are achieved and at the same time providing a level of roughness on the said trim in order to facilitate the user to grip the rifle.

Finally, it covers an area which, especially at night in front of lamps or of the moon could cause reflections and give away the hunter's position.

The said cover, with predetermined dimensions in function of the area to be covered, with the said area to be covered containing the screws that secure the shell propulsion mechanism to the support.

It also includes the means of fixing the cover to the mentioned sporting rifle which, in the drawings are shown as push-fit, elastic-fitting pins that bare inserted into at least two housings on the rifle support that receive and fit the said pins into the same, although it could quite easily be another some other means as that described in greater detail later.

BRIEF DESCRIPTION OF THE DRAWINGS

The invention will be better understood from the following full description of an embodiment example of the same, with includes references to the attached drawings, in which.

CONCRETE EMBODIMENT OF THE PATENT APPLICATION

Figure 1:
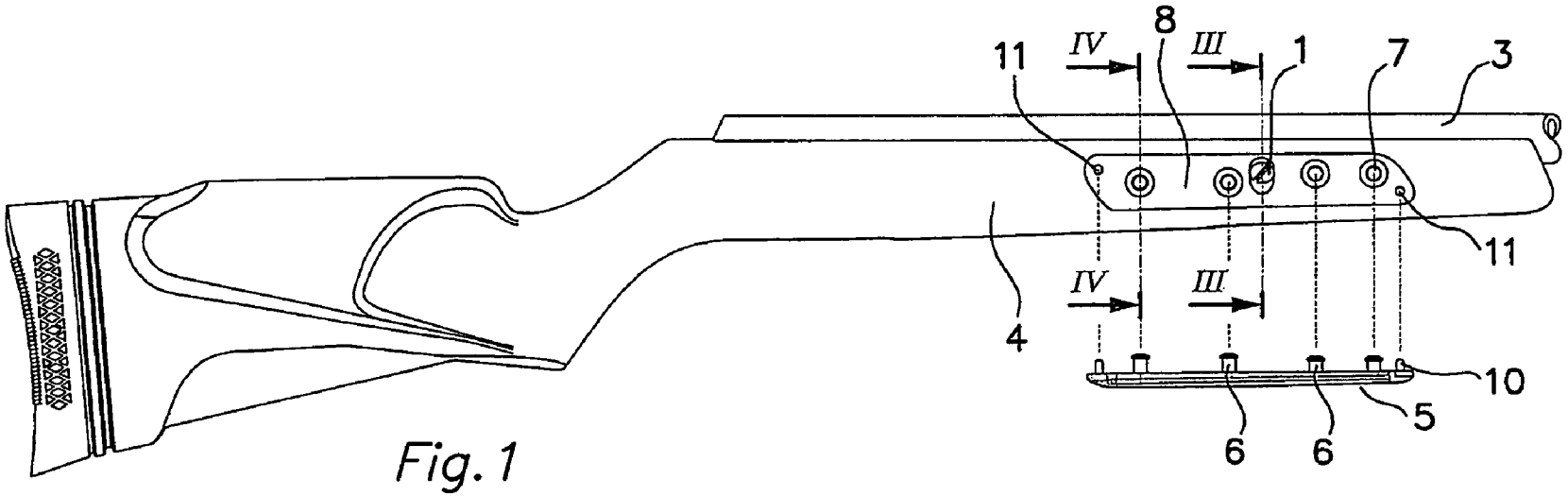
FIG. 1 is a side elevation view of a rifle screwed to a shell propulsion mechanism, partially shown, together with the cover proposed by this invention, seen in profile, prior to being fixed in place.

Thus, in the concrete embodiment example, FIG. 1 shows a head 1 of a screw, a shell propulsion mechanism 3, a support 4, a recess 8, some housings 7, some blind orifices 11, a cover 5, some pins 6 and a projection 10.

Figure 2:
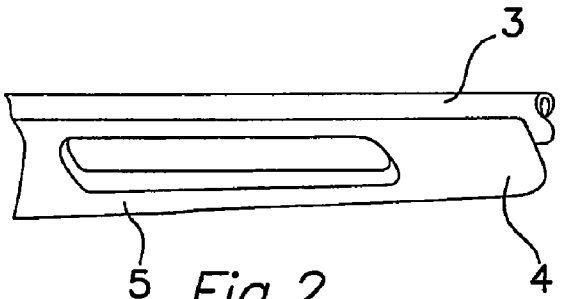
FIG. 2 shows a portion of the support and the shell propulsion mechanism of FIG. 1, with the cover mounted on top of them.

FIG. 2 shows the cited shell propulsion mechanism 3, the support 4 and the cover 5.

Figure 3:
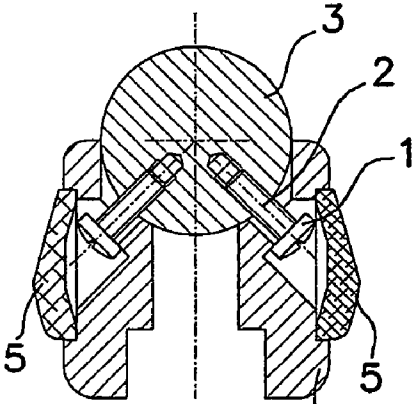
FIG. 3 is a cross-section view of the cover assembly on the support shown in FIG. 1, taking through section III-III of FIG. 1.

The stated shell propulsion mechanism 3, the support 4, some screws 2, the covers 5 and the heads 1 of the screws are shown in FIG. 3.

Figure 4:
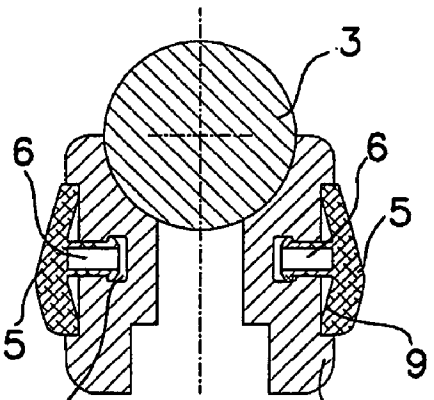
FIG. 4 is a cross-section view of the installation of the cover on the support shown in FIG. 1, taken through section IV-IV of FIG. 1.

Finally, the said shell propulsion mechanism 3, the support 4, the housings 7, the covers 5, the perimeter section 9 and the pins 6 are shown in FIG. 4.

In this specific embodiment example, it was decided to represent a case in which the means of securing consists of at least two push-fit, elastic-fitting pins 6 and because the support 4 for the rifle comprises at least two housings 7 that receive and fit around the said pins 6, although the said means of securing could also be achieved in any other way, for example, adhesive means, push-fit tabs in previously formed housings in the support 4 etc.

Just as shown in the attached figures, the proposed cover for this invention, which is applicable to sporting rifles, is used to cover the heads 1 of the screws 2 that secure the shell propulsion mechanism 3 to the support 4 of the said rifle. Normally the screws 2 are set out in an oblique fashion, as can be seen in FIGS. 1 and 3, with the said cover 5 being fixed to the said support 4 by some means of securing on its interior face. The said means of securing, as can be seen in FIGS. 1 and 4, consists of at least two push-fit, elastic-fitting pins 6 and the rifle support 4 comprises at least two housings 7 that house and fit said pins 6 in itself. In the embodiment example shown in FIG. 1, there are four pins 6, with a mushroom shape, with their respective housings 7 on the support 4, but it is evident that the number and shape of the same could be different as decided by an skilled person in the art.

FIG. 1 also shows that, in order for cover 5 to be positioned and correctly fit over support 4, this one has a recess 8 on part of its exterior surface with a shape and size that at least a perimeter portion 9 of the cover 5 fits onto the same, thus facilitating its positioning on support 4. In the embodiment example shown in FIG. 1, the cover 5 also consists of some additional means of positioning that collaborate with the said recess 8 in order to guarantee correct positioning. The cited means of positioning in this example are at least two projections 10 on the interior face of the cover that can fit into at least two blind orifices 11 on the rifle support 4 for this purpose. The cited means of positioning could also be some means of guidance that fit into place.

In another embodiment example (not shown), the said additional means of positioning are not necessary, with this function being achieved simply by the recess 8 made on the support 4.

As can be seen from the figures, the cover proposed in this invention is transversally convex towards the exterior and longitudinally elongated, although it could obviously have other shapes in other embodiment examples.

As can be seen from FIG. 2, the exterior surface of cover 5 is, at least in part, smooth and can therefore bear printed graphic information on its exterior face, such as the manufacturing company logo.

In a preferred embodiment example, the proposed cover is in a single piece and is obtained by the injection moulding of plastic material, which makes manufacturing costs relatively low, although the production procedure could easily be another that can provide similar results with respect to cover functionality.

This invention describes a new protective cover for sporting rifles. The examples described here do not limit this invention and may have different applications and/or adaptations, all of which are within the scope of the following claims.

The invention claimed is:

1. A rifle, comprising:

a rifle support;

a projectile propulsion mechanism comprising a barrel;

screws that pass through the rifle support and screw into the exterior wall of said projectile propulsion mechanism to fix the barrel to the rifle support; and a protective cover that covers an area on the rifle support including heads of the screws to protect a user therefrom, the protective cover comprising;

a main body having a predetermined length and width corresponding to a length and width of the area to be covered on the rifle support; and a fixing device that fixes the main body to the area to be covered, wherein the fixing device comprises one or more deformable protrusions on the main body that push-fit mate with one or more corresponding recesses on the rifle support.

2. The rifle in accordance with claim 1, wherein the main body is configured in size and shape such that at least part of a perimeter portion thereof mates with and is received in a recess formed on an exterior surface of the rifle support.

3. The rifle in accordance with claim 1, further comprising a positioning device that positions the main body on the rifle support.

4. The rifle in accordance with claim 1, wherein the main body is transversally convex towards an exterior thereof and longitudinally elongated.

5. The rifle in accordance with claim 1, wherein at least part of an exterior surface of the main body is smooth and can bear graphic printed information on the exterior surface.

6. The rifle in accordance with claim 1, wherein the cover comprises a single piece formed by injection molding a plastic material.

7. The rifle in accordance with claim 1, wherein the fixing device comprises at least two deformable protrusions that push-fit mate with at least two recesses that receive and fit around the deformable protrusions.

8. The rifle in accordance with claim 7, wherein the deformable protrusions have a mushroom shape.

9. The rifle in accordance with claim 3, wherein the positioning device comprises:

a plurality of positioning projections formed on an interior surface of the main body of the protective cover; and a plurality of positioning recesses formed on the area to be covered on the rifle support, the plurality of positioning recesses receiving corresponding ones of the plurality of positioning projections to properly position the main body of the cover on the area to be covered on the rifle support.

10. The rifle in accordance with claim 8, wherein the one or more corresponding recesses on the rifle support comprise generally cylindrical recesses on the rifle support, and wherein a diameter of the cylindrical recesses changes along the depth of the cylindrical recesses, the diameter of the cylindrical recesses being greater at greater depths in the cylindrical recesses.

* * * * *